US009939831B2

(12) United States Patent
Verma et al.

(10) Patent No.: US 9,939,831 B2
(45) Date of Patent: Apr. 10, 2018

(54) FAST SETTLING LOW DROPOUT VOLTAGE REGULATOR

(71) Applicant: SANDISK TECHNOLOGIES INC., Plano, TX (US)

(72) Inventors: Saurabh Verma, Bangalore (IN); Subodh Taigor, Bangalore (IN); Sridhar Yadala, Bangalore (IN)

(73) Assignee: SANDISK TECHNOLOGIES LLC, Plano, TX (US)

( * ) Notice: Subject to any disclaimer, the term of this patent is extended or adjusted under 35 U.S.C. 154(b) by 87 days.

(21) Appl. No.: 14/992,376

(22) Filed: Jan. 11, 2016

(65) Prior Publication Data

US 2017/0199536 A1 Jul. 13, 2017

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... H02M 3/07; H02M 3/073; H02M 2001/0009; H02M 2001/0045
See application file for complete search history.

(56) References Cited

U.S. PATENT DOCUMENTS 4,272,717 A 6/1981 Bailey
5,162,668 A 11/1992 Chen
5,283,514 A 2/1994 Hayward
7,034,585 B1 4/2006 Kiani
7,109,690 B2 9/2006 Ke
7,176,748 B2 2/2007 Khouri
7,372,320 B2 5/2008 Pan
7,397,227 B2 7/2008 Ke
7,626,367 B2 12/2009 Tsai
7,724,076 B2 5/2010 Byeon
8,710,914 B1 4/2014 Guhados
2002/0105848 A1* 8/2002 Tomita ..... G11C 5/147 365/226
2005/0073286 A1 4/2005 Ke
2005/0219878 A1* 10/2005 Ito ..... H02M 3/07 363/59
2005/0275450 A1* 12/2005 Shiga ..... H02M 3/073 327/536

(Continued)

OTHER PUBLICATIONS

512 Mbit PROM with a Three-Dimensional Array of Diode/Antifuse Memory Cells, Journal of Solid-State Circuits, Nov. 2003.

*Primary Examiner* — Henry Lee, III
(74) *Attorney, Agent, or Firm* — Vierra Magen Marcus LLP

(57) ABSTRACT

Methods and systems for reducing the settling time of a voltage regulator are described. In some cases, the settling time of the voltage regulator may be reduced by detecting that the voltage regulator is transitioning from a standby mode to an active mode and drawing additional current from the output of the voltage regulator during a current boosting phase. The current boosting phase may correspond with a current boosting pulse that is initiated when an enable signal is received from a controller and then is ended when the output voltage of the voltage regulator is within a first voltage of the desired regulation voltage or has overshot the desired regulation voltage by a second voltage (e.g., has overshot the desired regulation voltage by 150 mV).

20 Claims, 12 Drawing Sheets

(56) References Cited

U.S. PATENT DOCUMENTS

| | | | | |
|---|---|---|---|---|
| 2006/0214651 | A1 | 9/2006 | Ke | |
| 2008/0116866 | A1 | 5/2008 | Tsai | |
| 2013/0223133 | A1* | 8/2013 | Azuma | G11C 13/0007 365/148 |
| 2015/0097538 | A1* | 4/2015 | Le | H02M 3/158 323/271 |

* cited by examiner

FAST SETTLING LOW DROPOUT VOLTAGE REGULATOR

BACKGROUND

Semiconductor memory is widely used in various electronic devices such as cellular telephones, digital cameras, personal digital assistants, medical electronics, mobile computing devices, and non-mobile computing devices. Semiconductor memory may comprise non-volatile memory or volatile memory. A non-volatile memory allows information to be stored and retained even when the non-volatile memory is not connected to a source of power (e.g., a battery). Examples of non-volatile memory include flash memory (e.g., NAND-type and NOR-type flash memory) and Electrically Erasable Programmable Read-Only Memory (EEPROM).

Both flash memory and EEPROM utilize floating-gate transistors. For each floating-gate transistor, a floating gate is positioned above and insulated from a channel region of the floating-gate transistor. The channel region is positioned between source and drain regions of the floating-gate transistor. A control gate is positioned above and insulated from the floating gate. The threshold voltage of the floating-gate transistor may be controlled by setting the amount of charge stored on the floating gate. The amount of charge on the floating gate is typically controlled using Fowler-Nordheim (F-N) tunneling or hot-electron injection. The ability to adjust the threshold voltage allows a floating-gate transistor to act as a non-volatile storage element or memory cell. In some cases, more than one data bit per memory cell (i.e., a multi-level or multi-state memory cell) may be provided by programming and reading multiple threshold voltages or threshold voltage ranges.

NAND flash memory structures typically arrange multiple floating-gate transistors in series with and between two select gates. The floating-gate transistors in series and the select gates may be referred to as a NAND string. In recent years, NAND flash memory has been scaled in order to reduce cost per bit. However, as process geometries shrink, many design and process challenges are presented. These challenges include increased variability in transistor characteristics over process, voltage, and temperature (PVT) variations.

DETAILED DESCRIPTION

Figure 1:
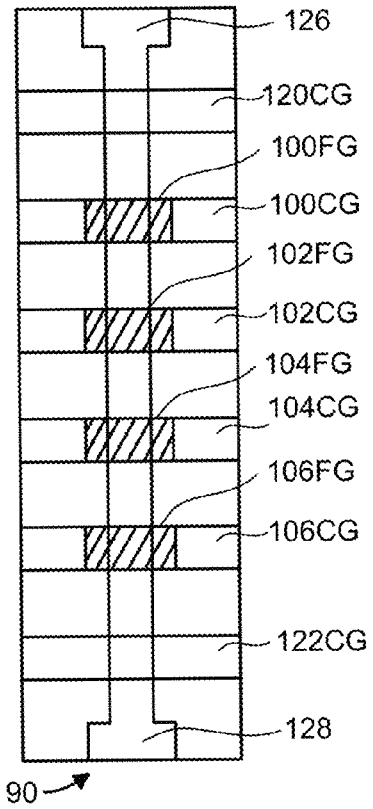
FIG. 1 depicts one embodiment of a NAND string.

Technology is described for reducing the settling time of a voltage regulator when generating a regulated voltage (e.g., a read voltage or a programming voltage). The settling time of the voltage regulator may comprise the time it takes for the voltage regulator to output a desired regulation voltage from a voltage different from the desired regulation voltage. In one example, the settling time may comprise the time to transition the output of the voltage regulator from a preset voltage (e.g., 5V or 0V) during in a standby mode to the desired regulation voltage (e.g., 3V) during an active mode (e.g., corresponding with the voltage generator generating a read voltage). In some cases, the settling time of the voltage regulator may be reduced by detecting that the voltage regulator is transitioning from the standby mode to the active mode and drawing additional current from the output of the voltage regulator during a current boosting phase. The current boosting phase may correspond with a current boosting pulse that is initiated when an enable signal is received from a controller and then is ended when the output voltage of the voltage regulator is within a first voltage (e.g., is within 50 mV of the desired regulation voltage) of the desired regulation voltage or has overshot the desired regulation voltage by a second voltage (e.g., has overshot the desired regulation voltage by 150 mV).

In one embodiment, the current boosting pulse associated with drawing additional current from the output of the voltage regulator may begin when an enable signal is received from one or more control circuits configured to perform or facilitate one or more memory array operations and then end after a disable signal is latched corresponding with when the output voltage of the voltage regulator first reaches a particular voltage level (e.g., is more than 200 mV above the desired regulation voltage or is at least 50 mV less than the desired regulation voltage). In some cases, the latched disable signal may then only be relatched after the enable signal from the one or more control circuits is toggled (e.g., transitions from VDD to 0V and then back to VDD). In one example, the disable signal may be latched only once after receiving a rising edge of the enable signal. The latched disable signal for determining when to stop drawing additional current from the output of the voltage regulator may be latched using a Reset/Set (RS) latch, a NAND gate latch, or a pair of cross-coupled NAND gates. One benefit of providing a current boosting pulse that begins when an enable signal is received from the one or more control circuits and ends when a disable signal is latched is that the pulse width of the current boosting pulse may be dynamically adjusted over various output load conditions and desired regulation voltages.

In some embodiments, the particular voltage level used for determining when the disable signal is latched may be set based on an output load condition (e.g., the amount of current to be drawn by the load), the desired regulation voltage (e.g., whether the desired regulation voltage is 2V or 10V), and/or the difference between the preset voltage (or precharged voltage) during a standby mode and the desired regulation voltage during an active mode. In one example, the particular voltage level may be set to 100 mV less than the desired regulation voltage if the difference between the preset voltage and the desired regulation voltage is less than 1V; otherwise, the particular voltage level may be set to 200 mV greater than the desired regulation voltage if the difference between the preset voltage and the desired regulation voltage is 1V or more than 1V. In this case, if the difference between the preset voltage and the desired regulation voltage is 1V or more than 1V, then the particular voltage level may dictate that an overshoot of the desired regulation voltage occurs. In another example, the particular voltage level may be set to the desired regulation voltage if the desired regulation voltage is less than 4V; otherwise, the particular voltage level may be set to the 150 mV greater than the desired regulation voltage if the desired regulation voltage is 4V or more than 4V. In this case, if the desired regulation voltage is more than 4V, then the particular voltage level may dictate that an overshoot of the desired regulation voltage occurs.

The methods and systems described herein for generating voltages using a voltage regulator may be used with various electronic circuits (e.g., digital or analog circuits) located on an integrated circuit. As examples, the integrated circuit may comprise a memory chip (e.g., DRAM, SRAM, Flash memory, etc.), a programmable logic device (e.g., FPGA or CPLD), a microprocessor, a microcontroller, a DSP, an ASIC, or an RF integrated circuit.

In one embodiment, a non-volatile storage system may include one or more two-dimensional arrays of non-volatile memory cells. The memory cells within a two-dimensional memory array may form a single layer of memory cells and may be selected via control lines (e.g., word lines and bit lines) in the X and Y directions. In another embodiment, a non-volatile storage system may include one or more monolithic three-dimensional memory arrays in which two or more layers of memory cells may be formed above a single substrate without any intervening substrates. In some cases, a three-dimensional memory array may include one or more vertical columns of memory cells located above and orthogonal to a substrate or substantially orthogonal to the substrate (e.g., within 2-5 degrees of a normal vector that is orthogonal to the substrate). In one example, a non-volatile storage system may include a memory array with vertical bit lines or bit lines that are arranged orthogonal to a semiconductor substrate. The substrate may comprise a silicon substrate. The memory array may comprise various memory structures including planar NAND structures, vertical NAND structures, Bit Cost Scalable (BiCS) NAND structures, 3D NAND structures, or 3D ReRAM structures.

In one embodiment, the memory cells within a memory array may comprise re-writable non-volatile memory cells including a reversible resistance-switching element. A reversible resistance-switching element may include a reversible resistivity-switching material having a resistivity that may be reversibly switched between two or more states. In one embodiment, the reversible resistance-switching material may include a metal oxide (e.g., a binary metal oxide). The metal oxide may include nickel oxide or hafnium oxide. In another embodiment, the reversible resistance-switching material may include a phase change material. The phase change material may include a chalcogenide material. In some cases, the re-writeable non-volatile memory cells may comprise resistive RAM (ReRAM) memory cells. In other cases, the re-writeable non-volatile memory cells may comprise conductive bridge memory cells or programmable metallization memory cells.

In some embodiments, a non-volatile storage system may include a non-volatile memory that is monolithically formed in one or more physical levels of arrays of memory cells having an active area disposed above a silicon substrate. The non-volatile storage system may also include circuitry associated with the operation of the memory cells (e.g., decoders, state machines, page registers, or control circuitry for controlling the reading or programming of the memory cells). The circuitry associated with the operation of the memory cells may be located above the substrate or located within the substrate.

In some embodiments, a non-volatile storage system may include a monolithic three-dimensional memory array. The monolithic three-dimensional memory array may include one or more levels of memory cells. Each memory cell within a first level of the one or more levels of memory cells may include an active area that is located above a substrate (e.g., above a single-crystal substrate or a crystalline silicon substrate). In one example, the active area may include a semiconductor junction (e.g., a P-N junction). The active area may include a portion of a source or drain region of a transistor. In another example, the active area may include a channel region of a transistor.

Figure 2:
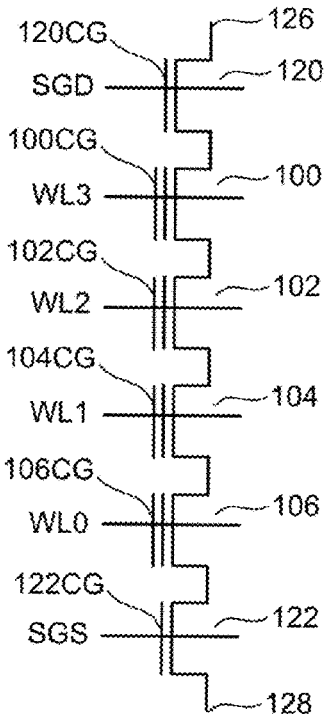
FIG. 2 depicts one embodiment of the NAND string of FIG. 1 using a corresponding circuit diagram.

FIG. 1 depicts one embodiment of a NAND string 90. FIG. 2 depicts one embodiment of the NAND string of FIG. 1 using a corresponding circuit diagram. As depicted, NAND string 90 includes four transistors, 100, 102, 104, and 106, in series between a first select gate 120 (i.e., a drain-side select gate) and a second select gate 122 (i.e., a source-side select gate). Select gate 120 connects the NAND string 90 to a bit line 126. Select gate 122 connects the NAND string 90 to a source line 128. Select gate 120 is controlled by applying the appropriate voltage to control gate 120CG (i.e., via select line SGD of FIG. 2). Select gate 122 is controlled by applying the appropriate voltage to control gate 122CG (i.e., via select line SGS of FIG. 2). Each of the transistors 100, 102, 104, and 106 includes a control gate and a floating gate. For example, transistor 100 includes control gate 100CG and floating gate 100FG, transistor 102 includes control gate 102CG and floating gate 102FG, transistor 104 includes control gate 104CG and floating gate 104FG, and transistor 106 includes control gate 106CG and floating gate 106FG. Control gates 100CG, 102CG, 104CG, and 106CG are connected to word lines WL3, WL2, WL1, and WL0, respectively.

Note that although FIGS. 1 and 2 show four floating-gate transistors in the NAND string, the use of four floating-gate transistors is only provided as an example. A NAND string may have less than or more than four floating-gate transistors (or memory cells). For example, some NAND strings may include 16 memory cells, 32 memory cells, 64 memory cells, 128 memory cells, etc. The discussion herein is not limited to any particular number of memory cells in a NAND string. One embodiment uses NAND strings with 66 memory cells, where 64 memory cells are used to store data and two of the memory cells are referred to as dummy memory cells because they do not store data.

A typical architecture for a flash memory system using a NAND flash memory structure includes a plurality of NAND strings within a memory block. A memory block may comprise a unit of erase. In some cases, the NAND strings within a memory block may share a common well (e.g., a P-well). Each NAND string may be connected to a common source line by its source-side select gate (e.g., controlled by select line SGS) and connected to its associated bit line by its drain-side select gate (e.g., controlled by select line SGD). Typically, each bit line runs on top of (or over) its associated NAND string in a direction perpendicular to the word lines and is connected to a sense amplifier.

In some embodiments, during a programming operation, storage elements that are not to be programmed (e.g., storage elements that have previously completed programming to a target data state) may be inhibited or locked out from programming by boosting associated channel regions (e.g., self-boosting the channel regions via word line coupling). An unselected storage element (or unselected NAND string) may be referred to as an inhibited or locked out storage element (or inhibited NAND string) as it is inhibited or locked out from programming during a given programming iteration of a programming operation.

Although technology using NAND-type flash memory may be described herein, the technology disclosed herein may also be applied to other types of non-volatile storage devices and architectures (e.g., NOR-type flash memory). Moreover, although technology using floating-gate transistors is described herein, the technology described herein may also be applied to or used with other memory technologies including those that employ charge trapping, phase-change (e.g., chalcogenide materials), or state-change materials.

Figure 3A:
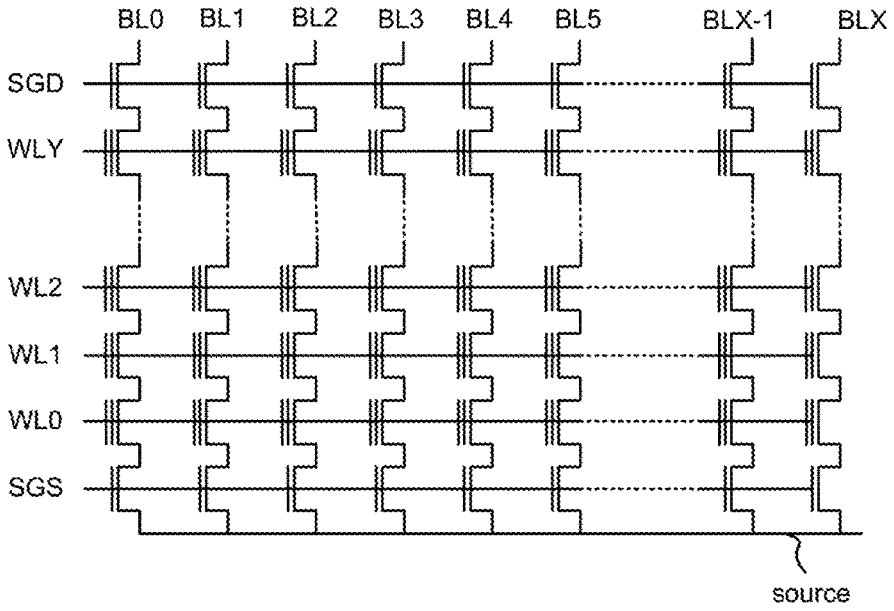
FIG. 3A depicts one embodiment of a memory block including a plurality of NAND strings.

FIG. 3A depicts one embodiment of a memory block including a plurality of NAND strings. As depicted, each NAND string includes (Y+1) memory cells. Each NAND string is connected to one bit line out of (X+1) bit lines on the drain side (i.e., one bit line of bit lines BL0-BLX) via a drain-side select gate controlled by the drain-side selection signal SGD. Each NAND string is connected to a source line (source) via a source-side select gate controlled by source-side selection signal SGS. In one embodiment, the source-side select gate controlled by source-side selection signal SGS and the drain-side select gate controlled by the drain-side selection signal SGD may comprise transistors without floating gates or transistors that include a floating gate structure.

In one embodiment, during a programming operation, when programming a memory cell, such as a NAND flash memory cell, a program voltage may be applied to the control gate of the memory cell and the corresponding bit line may be grounded. These programming bias conditions may cause electrons to be injected into the floating gate via field-assisted electron tunneling, thereby raising the threshold voltage of the memory cell. The program voltage applied to the control gate during a program operation may be applied as a series of pulses. In some cases, the magnitude of the programming pulses may be increased with each successive pulse by a predetermined step size. Between programming pulses, one or more verify operations may be performed. During the programming operation, memory cells that have reached their intended programming states may be locked out and inhibited from programming by boosting the channel regions of the program inhibited memory cells.

In one embodiment, memory cells may be erased by raising the p-well to an erase voltage (e.g., 20 volts) for a sufficient period of time and grounding the word lines of a selected block of memory cells while the source and bit lines are floating. These erase bias conditions may cause electrons to be transferred from the floating gate through the tunneling oxide, thereby lowering the threshold voltage of the memory cells within the selected block. In some cases, an erase operation may be performed on an entire memory plane, on individual blocks within a memory plane, or another unit of memory cells.

In some embodiments, during verify operations and/or read operations, a selected word line may be connected (or biased) to a voltage, a level of which is specified for each read and verify operation in order to determine whether a threshold voltage of a particular memory cell has reached such level. After applying the word line voltage, the conduction current of the memory cell may be measured (or sensed) to determine whether the memory cell conducted a sufficient amount of current in response to the voltage applied to the word line. If the conduction current is measured to be greater than a certain value, then it is assumed that the memory cell turned on and the voltage applied to the word line is greater than the threshold voltage of the memory cell. If the conduction current is not measured to be greater than the certain value, then it is assumed that the memory cell did not turn on and the voltage applied to the word line is not greater than the threshold voltage of the memory cell.

There are many ways to measure the conduction current of a memory cell during a read or verify operation. In one example, the conduction current of a memory cell may be measured by the rate it discharges or charges a dedicated capacitor in a sense amplifier. In another example, the conduction current of the selected memory cell allows (or fails to allow) the NAND string that included the memory cell to discharge a voltage on the corresponding bit line. The voltage of the bit line (or the voltage across a dedicated capacitor in a sense amplifier) may be measured after a period of time to determine whether the bit line has been discharged by a particular amount or not.

Figure 3B:
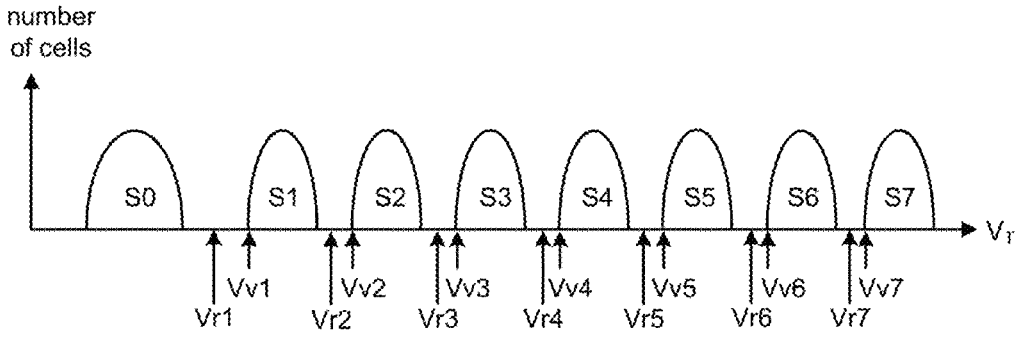
FIG. 3B depicts one embodiment of possible threshold voltage distributions for a three-bit-per-cell memory cell.

FIG. 3B depicts one embodiment of possible threshold voltage distributions (or data states) for a three-bit-per-cell memory cell (i.e., the memory cell may store three bits of data). Other embodiments, however, may use more than or less than three bits of data per memory cell (e.g., such as four or more bits of data per memory cell). At the end of a successful programming process (with verification), the threshold voltages of memory cells within a memory page or memory block should be within one or more threshold voltage distributions for programmed memory cells or within a distribution of threshold voltages for erased memory cells, as appropriate.

As depicted, each memory cell may store three bits of data; therefore, there are eight valid data states S0-S7. In one embodiment, data state S0 is below 0 volts and data states S1-S7 are above 0 volts. In other embodiments, all eight data states are above 0 volts, or other arrangements can be implemented. In one embodiment, the threshold voltage distribution S0 is wider than distributions S1-S7.

Each data state S0-S7 corresponds to a unique value for the three bits stored in the memory cell. In one embodiment, S0=111, S1=110, S2=101, S3=100, S4=011, S5=010, S6=001 and S7=000. Other mappings of data to states S0-S7 can also be used. In one embodiment, all of the bits of data stored in a memory cell are stored in the same logical page. In other embodiments, each bit of data stored in a memory cell corresponds to different pages. Thus, a memory cell storing three bits of data would include data in a first page, a second page, and a third page. In some embodiments, all of the memory cells connected to the same word line would store data in the same three pages of data. In some embodiments, the memory cells connected to a word line can be grouped into different sets of pages (e.g., by odd and even bit lines).

In some example implementations, the memory cells will be erased to state S0. From state S0, the memory cells can be programmed to any of states S1-S7. Programming may be performed by applying a set of pulses with rising magnitudes to the control gates of the memory cells. Between pulses, a set of verify operations may be performed to determine whether the memory cells being programmed have reached their target threshold voltage (e.g., using verify levels Vv1, Vv2, Vv3, Vv4, Vv5, Vv6, and Vv7). Memory cells being programmed to state S1 will be tested to see if their threshold voltage has reached Vv1. Memory cells being programmed to state S2 will be tested to see if their threshold voltage has reached Vv2. Memory cells being programmed to state S3 will be tested to see if their threshold voltage has reached Vv3. Memory cells being programmed to state S4 will be tested to see if their threshold voltage has reached Vv4. Memory cells being programmed to state S5 will be tested to see if their threshold voltage has reached Vv5. Memory cells being programmed to state S6 will be tested to see if their threshold voltage has reached Vv6. Memory cells being programmed to state S7 will be tested to see if their threshold voltage has reached Vv7.

When reading memory cells that store three bits of data, multiple reads will be performed at read compare points Vr1, Vr2, Vr3, Vr4, Vr5, Vr6, and Vr7 to determine which state the memory cells are in. If a memory cell turns on in response to Vr1, then it is in state S0. If a memory cell turns on in response to Vr2 but does not turn on in response to Vr1, then it is in state S1. If a memory cell turns on in response to Vr3 but does not turn on in response to Vr2, then it is in state S2. If a memory cell turns on in response to Vr4 but does not turn on in response to Vr3, then it is in state S3. If a memory cell turns on in response to Vr5 but does not turn on in response to Vr4, then it is in state S4. If a memory cell turns on in response to Vr6 but does not turn on in response to Vr5, then it is in state S5. If a memory cell turns on in response to Vr7 but does not turn on in response to Vr6, then it is in state S6. If a memory cell does not turn on in response to Vr7, then it is in state S7.

Figure 3C:
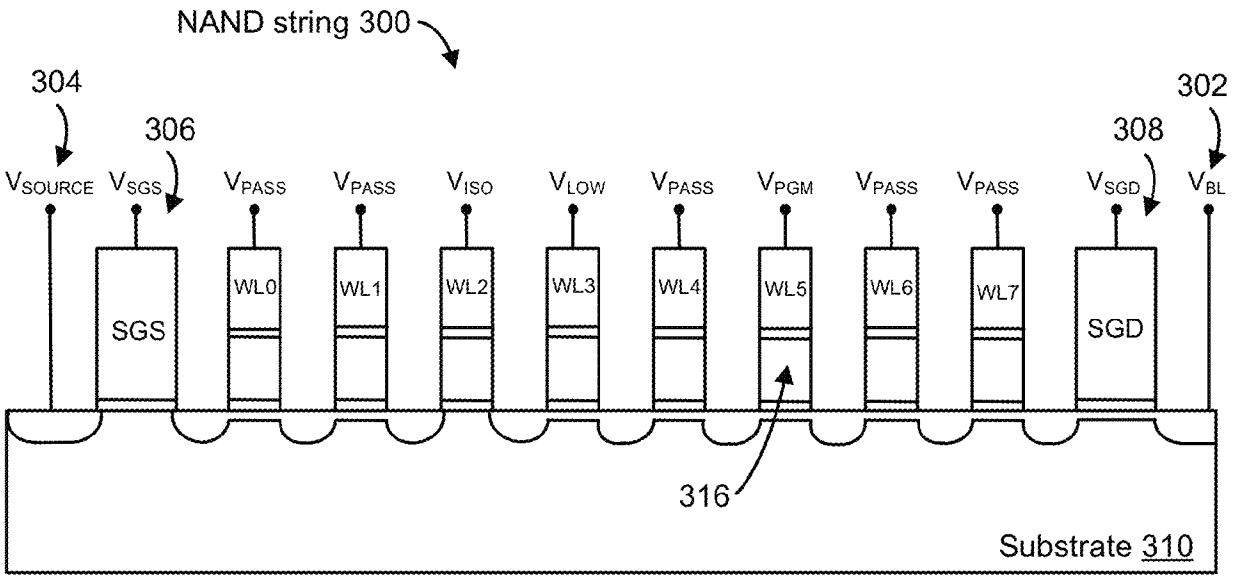
FIG. 3C depicts one embodiment of a NAND string during a programming operation.

FIG. 3C depicts one embodiment of a NAND string 300 during a programming operation. When programming a storage element (e.g., the storage element 316 associated with WL5) of the NAND string 300, a programming voltage may be applied to the selected word line associated with the storage element and a low voltage (e.g., ground) may be applied to the bit line associated with the storage element. As depicted, the NAND string 300 includes a source-side select gate 306, a drain-side select gate 308, and eight word lines WL0-WL7 formed above a substrate 310. $V_{SGS}$ may be applied to the source-side select gate 306 and $V_{SGD}$ may be applied to the drain-side select gate 308. The bit line 302 may be biased to $V_{BL}$ and the source line 304 may be biased to $V_{SOURCE}$. During a programming operation, a programming voltage, $V_{PGM}$, may be applied to selected word line WL5, which is associated with a selected storage element 316.

In one example of a boosting mode, when storage element 316 is the selected storage element, a relatively low voltage, $V_{LOW}$ (e.g., 2-6V) may be applied to a source-side word line (WL3), while an isolation voltage, $V_{ISO}$ (e.g., 0-4V) may be applied to another source-side word line (WL2), referred to as an isolation word line and a pass voltage, $V_{PASS}$, may be applied to the remaining word lines associated with NAND string 300 (in this case word lines WL0, WL1, WL4, WL6, and WL7). While the absolute values of $V_{ISO}$ and $V_{LOW}$ may vary over a relatively large and partly overlapping range, $V_{ISO}$ may be less than $V_{LOW}$. In some cases, $V_{ISO}$ may be less than $V_{LOW}$ which is less than $V_{PASS}$ which is less than $V_{PGM}$.

In some cases, a vertical NAND structure may comprise a vertical NAND string or a vertical inverted NAND string. A NAND string may comprise a string of floating gate transistors. An inverted NAND string may comprise a string of inverted floating gate transistors.

Figure 4A:
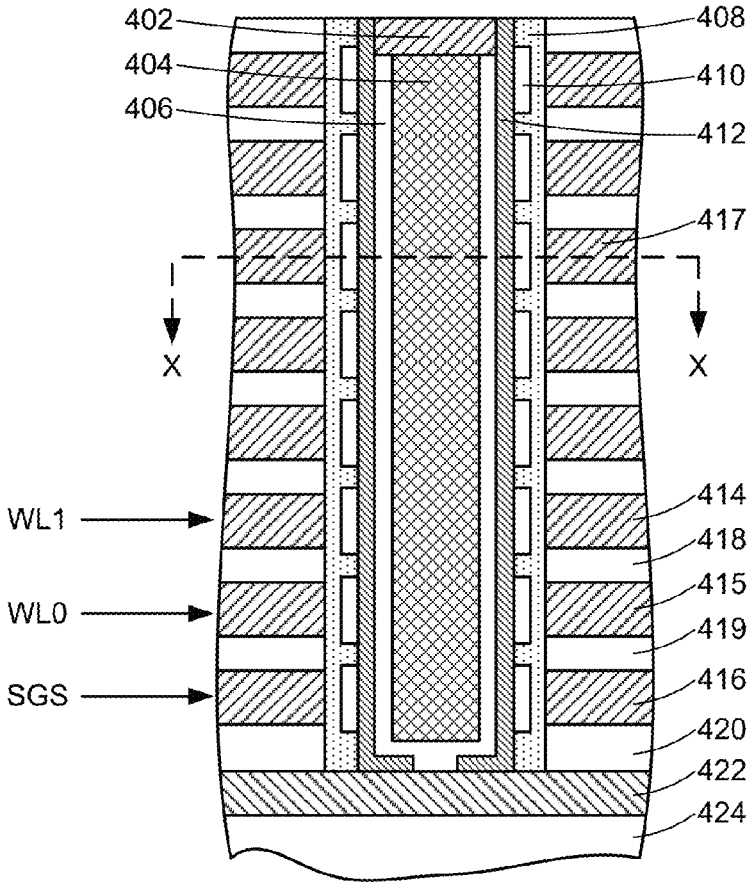
FIG. 4A depicts one embodiment of a vertical NAND structure.

FIG. 4A depicts one embodiment of a vertical NAND structure. The vertical NAND structure includes an inverted NAND string formed above the substrate 424 and oriented such that the inverted NAND string is orthogonal to the substrate 424. An inverted NAND string may comprise a NAND string that includes an inverted floating gate transistor with a tunneling oxide between a floating gate of the inverted floating gate transistor and a control gate of the inverted floating gate transistor. The arrangement of the tunneling oxide between the floating gate and the control gate allows the mechanism (e.g., F-N tunneling as the transport mechanism) for programming and/or erase of the inverted floating gate transistor to occur between the floating gate and the control gate rather than between the floating gate and the channel of the inverted floating gate transistor. The inverted NAND string may be arranged within a vertical memory hole that is etched through alternating layers of control gate material (e.g., tungsten, nitride, or polysilicon) and inter-gate insulator material (e.g., oxide or silicon dioxide). As depicted, the layers of control gate material include layer 417 and layers 414-416 and the layers of inter-gate insulator material include layers 418-420. The inter-gate insulator material layer 420 may be arranged above a source line layer 422 (e.g., doped polysilicon) that may be arranged above a substrate 424 (e.g., a silicon substrate). In some cases, a first word line (WL1) may correspond with control gate layer 414, a second word line (WL0) may correspond with control gate layer 415, and a source-side select gate line (SGS) may correspond with control gate layer 416.

In one embodiment, within the memory hole a tunneling layer material 408 (e.g., including a thin oxide), a floating gate material 410 (e.g., polysilicon), a dielectric layer 412 (e.g., oxide), and a channel layer material 406 (e.g., undoped polysilicon) may be deposited within the memory hole and arranged in order to form the inverted NAND string. As depicted in FIG. 4A, the tunneling layer material 408 is arranged within or inside of the memory hole. The tunneling layer material 408 may comprise a portion of a multi-layer dielectric stack such as an ONO dielectric stack, which includes alternating layers of silicon dioxide ("O") and silicon nitride ("N"). In some cases, the tunneling layer material 408 may comprise a high-K dielectric material (e.g., hafnium-based high-K dielectrics or hafnium oxide) that has a dielectric constant that is greater than that of silicon dioxide. In some cases, a core material layer 404 (e.g., oxide) may be formed within the memory hole. In other cases, the core material layer 404 may be omitted. A bit line contact layer 402 may be formed at the top of the memory hole and connect to or directly abut the channel layer material 406. The channel layer material 406 may connect to the source line layer 422 at the bottom of the memory hole. Thus, in this case, the bit line contact layer 402 connects to the inverted NAND string at the top of the memory hole and the source line contact layer 422 connects to the inverted NAND string at the bottom of the memory hole.

In one embodiment, the bit line contact layer 402 may comprise a material of a first conductivity type (e.g., n-type) and the source line contact layer 422 may comprise a material of a second conductivity type different from the first conductivity type (e.g., p-type). In one example, the bit line contact layer 402 may comprise an n-type material (e.g., n-type polysilicon) and the source line contact layer 422 may comprise a p-type material (e.g., p-type polysilicon). In another example, the bit line contact layer 402 may comprise a p-type material and the source line contact layer 422 may comprise an n-type material (e.g., n-type polysilicon). Thus, in some cases, the inverted NAND string may include an asymmetric source and drain that may be used to provide both an electron supply (via the n-type material) and a hole supply (via the p-type material) for memory operations (e.g., program, erase, and read operations) performed using the inverted NAND string. The memory operations may comprise n-channel operations and/or p-channel operations depending on the bias conditions applied to the inverted NAND string.

In one embodiment, an inverted NAND string may be formed using a core material layer (e.g., an oxide layer or other dielectric layer) that is arranged adjacent to a channel layer (e.g., an undoped polysilicon channel layer) that is arranged adjacent to a blocking layer (e.g., an oxide layer or other dielectric layer) that is arranged adjacent to a floating gate layer (or a charge trap layer) that is arranged adjacent to a tunneling layer (e.g., a thin oxide) that is arranged adjacent to a control gate layer (e.g., tungsten). The tunneling layer may have a thickness that is less than the thickness of the blocking layer.

Figure 4B:
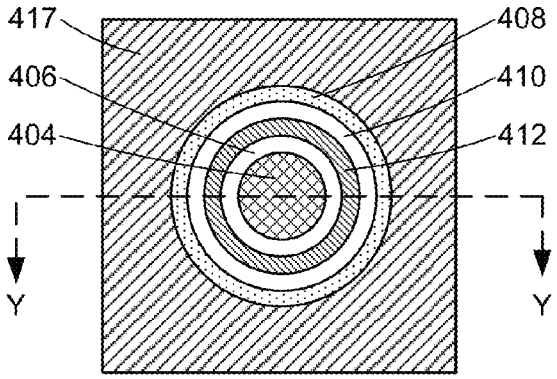
FIG. 4B depicts one embodiment of a cross-sectional view taken along line X-X of FIG. 4A.

FIG. 4B depicts one embodiment of a cross-sectional view taken along line X-X of FIG. 4A. As depicted, the inverted NAND string includes an inner core material layer 404 that is surrounded by the channel layer material 406 that is surrounded by the dielectric layer 412 that is surrounded by the floating gate material 410 that is surrounded by the tunneling layer material 408 that is surrounded by the control gate material layer 417. In one embodiment, FIG. 4A may depict a cross-sectional view taken along line Y-Y of FIG. 4B. In one embodiment, the inverted NAND string may be formed using a vertical cylindrical structure or a vertical tapered cylindrical structure. In this case, the dielectric material 412, floating gate material 410, tunneling layer material 408, and channel layer material 406 of the inverted NAND string may comprise vertical annular structures surrounding the core material layer 404. In another embodiment, the inverted NAND string may be formed using a vertical pillar structure or a vertical rectangular prism structure.

Figure 5A:
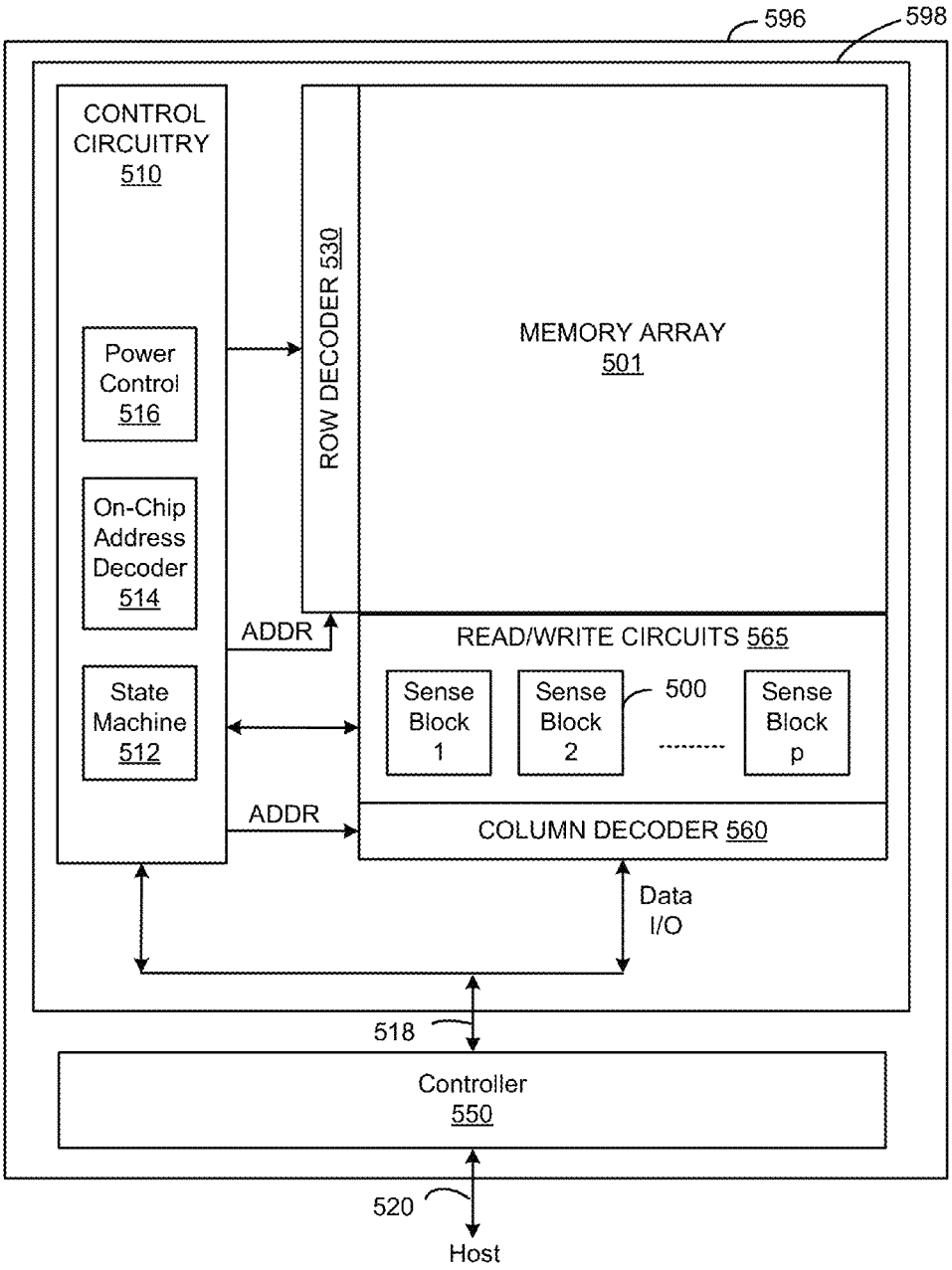
FIG. 5A depicts one embodiment of a non-volatile storage system.

FIG. 5A depicts one embodiment of a non-volatile storage system 596 including read/write circuits for reading and programming a page (or other unit) of memory cells (e.g., NAND multi-level cells) in parallel. As depicted, non-volatile storage system 596 includes a memory die 598 and controller 550. Memory die 598 includes a memory array 501 (e.g., a NAND flash memory array), control circuitry 510, row decoder 530, column decoder 560, and read/write circuits 565. In one embodiment, access to the memory array 501 by the various peripheral circuits (e.g., row decoders or column decoders) is implemented in a symmetric fashion, on opposite sides of the array, so that the densities of access lines and circuitry on each side are reduced by half. The memory array 501 is addressable by word lines via a row decoder 530 and by bit lines via a column decoder 560. Word lines and bit lines are examples of memory array control lines. The read/write circuits 565 include multiple sense blocks 500 that allow a page of storage elements to be read or programmed in parallel. In some cases, controller 550 may be integrated on the memory die 598. Commands and data are transferred between the host and controller 550 via lines 520 and between the controller 550 and the memory die 598 via lines 518.

The control circuitry 510 cooperates with the read/write circuits 565 to perform memory operations on the memory array 501. The control circuitry 510 includes a state machine 512, an on-chip address decoder 514, and a power control module 516. The state machine 512 provides chip-level control of memory operations. The on-chip address decoder 514 provides an address interface between the addresses used by the host and the hardware addresses used by the decoders 530 and 560. The power control module 516 controls the power and voltages supplied to the word lines and bit lines during memory operations. In one embodiment, a power control module 516 includes one or more charge pumps that may generate voltages greater than the supply voltage.

In some embodiments, one or more of the components (alone or in combination), other than memory array 501, may be referred to as a managing or control circuit. For example, one or more managing or control circuits may include any one of or a combination of control circuitry 510, state machine 512, decoders 530/560, power control 516, sense blocks 500, read/write circuits 565, controller 550, and so forth. The one or more managing circuits or the one or more control circuits may perform or facilitate one or more memory array operations including erasing, programming, or reading operations.

In some embodiments, one or more managing or control circuits may be used for controlling the operation of a memory array, such as memory array 501. The one or more managing or control circuits may provide control signals to the memory array in order to perform a read operation and/or a write operation on the memory array. In one example, the one or more managing or control circuits may include any one of or a combination of control circuitry, state machine, decoders, sense amplifiers, read/write circuits, and/or controllers. The one or more control circuits may enable or facilitate one or more memory array operations including erasing, programming, or reading operations to be performed on the memory array. In one example, the one or more control circuits may comprise an on-chip memory controller for determining row and column addresses, word line and bit line addresses, memory array enable signals, and/or data latching signals.

In one embodiment, memory array 501 may be divided into a large number of blocks (e.g., blocks 0-1023, or another amount) of memory cells. As is common for flash memory systems, the block may be the unit of erase. That is, each block may contain the minimum number of memory cells that are erased together. Other units of erase can also be used. A block contains a set of NAND strings which are accessed via bit lines and word lines. Typically, all of the NAND strings in a block share a common set of word lines.

Each block may be divided into a particular number of pages. In one embodiment, a page may be the unit of programming. Other units of programming can also be used. One or more pages of data are typically stored in one row of memory cells. For example, one or more pages of data may be stored in memory cells connected to a common word line. In one embodiment, the set of memory cells that are connected to a common word line are programmed simultaneously. A page can store one or more sectors. A sector may include user data and overhead data (also called system data). Overhead data typically includes header information and Error Correction Codes (ECC) that have been calculated from the user data of the sector. The controller (or other component) calculates the ECC when data is being programmed into the array, and also checks it when data is being read from the array. Alternatively, the ECC and/or other overhead data may be stored in different pages, or even different blocks, than the user data to which they pertain. A sector of user data is typically 512 bytes, corresponding to the size of a sector in magnetic disk drives. A large number of pages form a block, anywhere from 8 pages, for example, up to 32, 64, 128 or more pages. Different sized blocks, pages, and sectors can also be used.

Figure 5B:
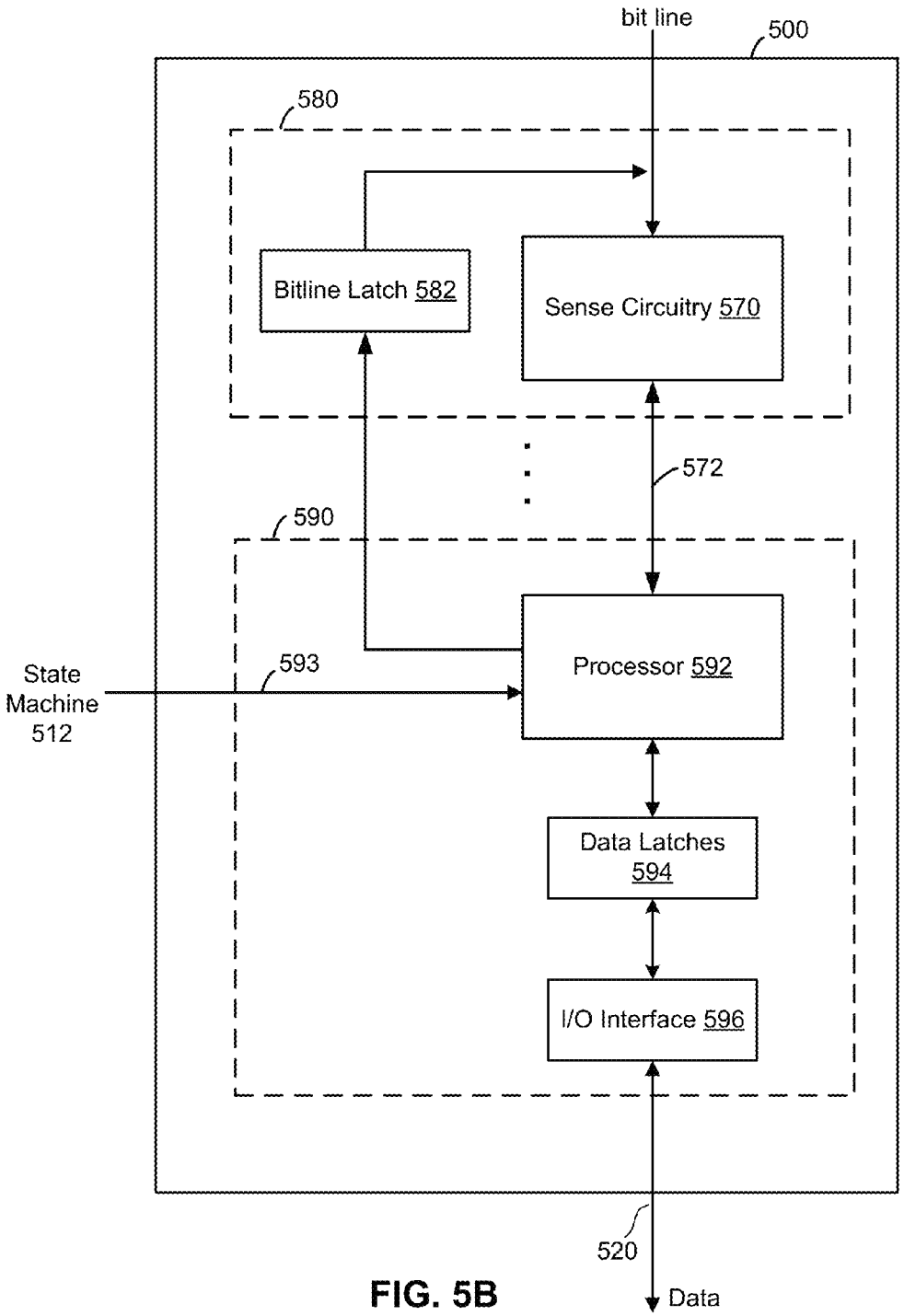
FIG. 5B depicts one embodiment of a sense block.

FIG. 5B depicts one embodiment of a sense block 500, such as sense block 500 in FIG. 5A. An individual sense block 500 may be partitioned into a core portion, referred to as a sense module 580, and a common portion 590. In one embodiment, there is a separate sense module 580 for each bit line and one common portion 590 for a set of multiple sense modules 580. In one example, a sense block will include one common portion 590 and eight sense modules 580. Each of the sense modules in a group will communicate with the associated common portion via a data bus 572.

Sense module 580 comprises sense circuitry 570 that determines whether a conduction current in a connected bit line is above or below a predetermined threshold level. Sense module 580 also includes a bit line latch 582 that is used to set a voltage condition on the connected bit line. For example, a predetermined state latched in bit line latch 582 may result in the connected bit line being pulled to a state designating program inhibit voltage (e.g., 1.5-3 V).

Common portion 590 comprises a processor 592, a set of data latches 594, and an I/O Interface 596 coupled between the set of data latches 594 and data bus 520. Processor 592 performs computations. For example, processor 592 may determine the data stored in the sensed storage element and store the determined data in the set of data latches. The set of data latches 594 may be used to store data bits determined by processor 592 during a read operation or to store data bits imported from the data bus 520 during a program operation. The imported data bits represent write data meant to be programmed into a memory array, such as memory array 501 in FIG. 5A. I/O interface 596 provides an interface between data latches 594 and the data bus 520.

During a read operation or other storage element sensing operation, a state machine, such as state machine 512 in FIG. 5A, controls the supply of different control gate voltages to the addressed storage elements. As it steps through the various predefined control gate voltages corresponding to the various memory states supported by the memory, the sense module 580 may trip at one of these voltages and an output will be provided from sense module 580 to processor 592 via bus 572. At that point, processor 592 determines the resultant memory state by consideration of the tripping event(s) of the sense module and the information about the applied control gate voltage from the state machine via input lines 593. It then computes a binary encoding for the memory state and stores the resultant data bits into data latches 594. In another embodiment of the core portion, bit line latch 582 serves both as a latch for latching the output of the sense module 580 and as a bit line latch as described above.

During a programming operation, the data to be programmed is stored in the set of data latches 594. The programming operation, under the control of the state machine 512, comprises a series of programming voltage pulses applied to the control gates of the addressed storage elements. Each program pulse is followed by a read back (or verify process) to determine if the storage element has been programmed to the desired memory state. Processor 592 monitors the read back memory state relative to the desired memory state. When the two are in agreement, the processor 592 sets the bit line latch 582 so as to cause the bit line to be pulled to a state designating program inhibit voltage. This inhibits the storage element coupled to the bit line from further programming even if program pulses appear on its control gate. In other embodiments, the processor initially loads the bit line latch 582 and the sense circuitry sets it to an inhibit value during the verify process.

Data latch stack 594 contains a stack of data latches corresponding to the sense module. In one embodiment, there are three data latches per sense module 580. The data latches can be implemented as a shift register so that the parallel data stored therein is converted to serial data for data bus 520, and vice-versa. All the data latches corresponding to a read/write block can be linked together to form a block shift register so that a block of data can be input or output by serial transfer. In particular, the bank of read/write modules may be configured such that each of its set of data latches will shift data in to or out of the data bus in sequence as if they are part of a shift register for the entire read/write block.

In some embodiments, a non-volatile storage system, such as non-volatile storage system 596 in FIG. 5A, may be implemented using an integrated circuit. The integrated circuit may include on-chip circuitry to generate a boosted voltage having a magnitude that is greater than the highest power supply voltage provided to the integrated circuit. The boosted voltage may be used for providing power to portions of the electronic circuitry located on the integrated circuit. The boosted voltage may be generated using an on-chip charge pump system. In some cases, a charge pump system may be used to generate an output voltage that is greater than the highest supply voltage provided to the integrated circuit. In other cases, a charge pump system may be used to generate an output voltage that is less than the lowest supply voltage provided to the integrated circuit (e.g., a negative charge pump system may generate a voltage that is less than ground or VSS).

Figure 6A:
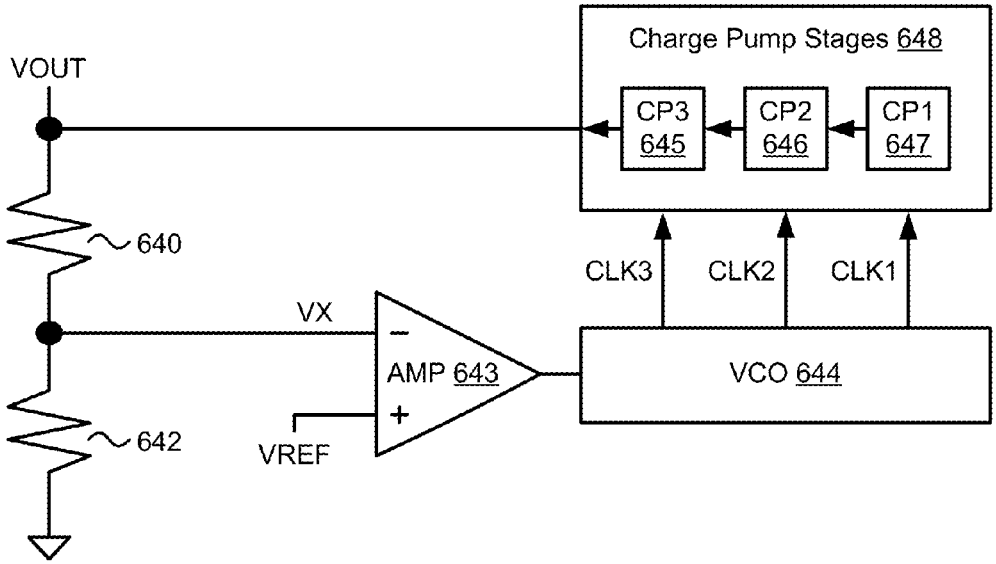
FIG. 6A depicts one embodiment of a charge pump system for generating voltages greater than a supply voltage.

FIG. 6A depicts one embodiment of a charge pump system for generating voltages greater than a supply voltage. The supply voltage may be provided via an external voltage source that is external to an integrated circuit incorporating the charge pump system or via a voltage regulator that is located outside of the integrated circuit. As depicted, the charge pump system includes one or more charge pump stages 648, a comparator AMP 643, a voltage controlled oscillator VCO 644, and a voltage divider formed by resistors 640 and 642. The output voltage of the charge pump system, VOUT, may be used as an input voltage to on-chip voltage regulators in order to provide various voltage references to a memory array (e.g., selected word line voltages, unselected word line voltages, selected bit line voltages, and unselected bit line voltages). As depicted, a reference voltage VREF (e.g., 1.25V) is used as an input to comparator AMP 643. Due to closed-loop feedback, the voltage at node VX will be close to (or substantially the same as) VREF and the voltage at node VOUT will be a multiplier higher than the voltage at node VX due to the voltage divider formed by resistors 640 and 642.

The comparator AMP 643 drives the voltage controlled oscillator VCO 644. VCO 644 generates a plurality of clock signals, such as CLK1, CLK2, and CLK3. The output of comparator AMP 643 may adjust a frequency of the plurality of clock signals. In one example, if the voltage at node VX is less than the VREF voltage, then the output of comparator AMP 643 may cause the VCO 644 to increase the frequency of the plurality of clock signals. The VCO 644 drives the one or more charge pump stages 648 that generate voltages higher than the supply voltage provided. As depicted, the one or more charge pump stages 648 include three charge pump stages CP1 647, CP2 646, and CP3 645. CP1 647 may be used to boost an input voltage (e.g., the supply voltage) to a first voltage, CP2 646 may be used to boost the first voltage to a second voltage, and CP3 645 may be used to boost the second voltage to the output voltage. Each charge pump stage of the one or more charge pump stages may include a pair of diodes, a pair of diode-connected transistors, a pair of transistors, or a pair of charge transfer switches. Resistor and/or transistor trimming options for the voltage divider formed by resistors 640 and 642 may be used to modify the resulting output voltage VOUT. The reference voltage VREF may comprise a temperature insensitive reference voltage or a temperature dependent reference voltage. In one embodiment, VREF may be generated using a bandgap voltage reference or be derived from a bandgap-based voltage reference.

In some embodiments, a charge pump stage of the one or more charge pump stages 648 may include a boosting capacitor that is charged to a charging voltage (e.g., VDD or a voltage provided by a previous charge pump stage) during a charging phase. After the charging phase, the boosting capacitor may be boosted during a boosting phase. In one example, a clock signal connected to one end of the boosting capacitor may boost the boosting capacitor by transitioning from a first voltage to a second voltage greater than the first voltage (e.g., from 0V to 3V).

Figure 6B:
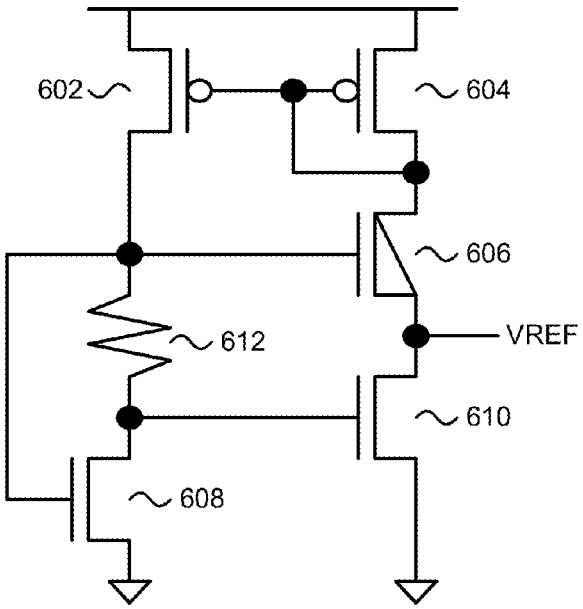
FIG. 6B depicts one embodiment of a voltage reference generator.

FIG. 6B depicts one embodiment of a voltage reference generator including transistors 602-610 and resistor 612 for generating a reference voltage, such as VREF in FIG. 6A. Transistors 608 and 610 comprise nMOS transistors. Transistors 602 and 604 comprise pMOS transistors in a current mirror configuration. Transistor 606 comprises a low VT nMOS transistor. As depicted, the voltage reference generator generates and combines a proportional to absolute temperature (PTAT) voltage and a complementary to absolute temperature (CTAT) voltage based on a difference in transistor VTs between transistor 608 and transistor 606. By modifying the degree to which the PTAT voltage and the CTAT voltage are combined, a resulting output voltage may be created that is either PTAT, CTAT, or substantially independent of temperature. In one embodiment, the devices are sized such that VREF provides a temperature insensitive reference voltage. Resistor and transistor trimming options may be used to modify the resulting output voltage and its slope over temperature. One benefit of using a voltage reference generator based on a difference in transistor VTs is that, unlike voltage references based on the base-emitter voltage of a bipolar junction transistor (e.g., a bandgap voltage reference), reference voltages may be generated over a wide range of temperatures using a sub-1V voltage supply. More information regarding voltage reference generation may be found in U.S. Pat. No. 7,999,529, "Methods and Apparatus for Generating Voltage References Using Transistor Threshold Differences."

In some embodiments, a voltage reference that is stable across PVT variations (e.g., VREF) may be used for generating regulated voltages (e.g., a selected word line voltage during a read operation or an unselected word line voltage during a programming operation) that are used for biasing word lines and/or bit lines within a memory array during a memory operation. The memory operation may comprise a read operation, a programming operation, or an erase operation. The regulated voltage may be generated using a non-inverting amplifier configuration.

Figure 7A:
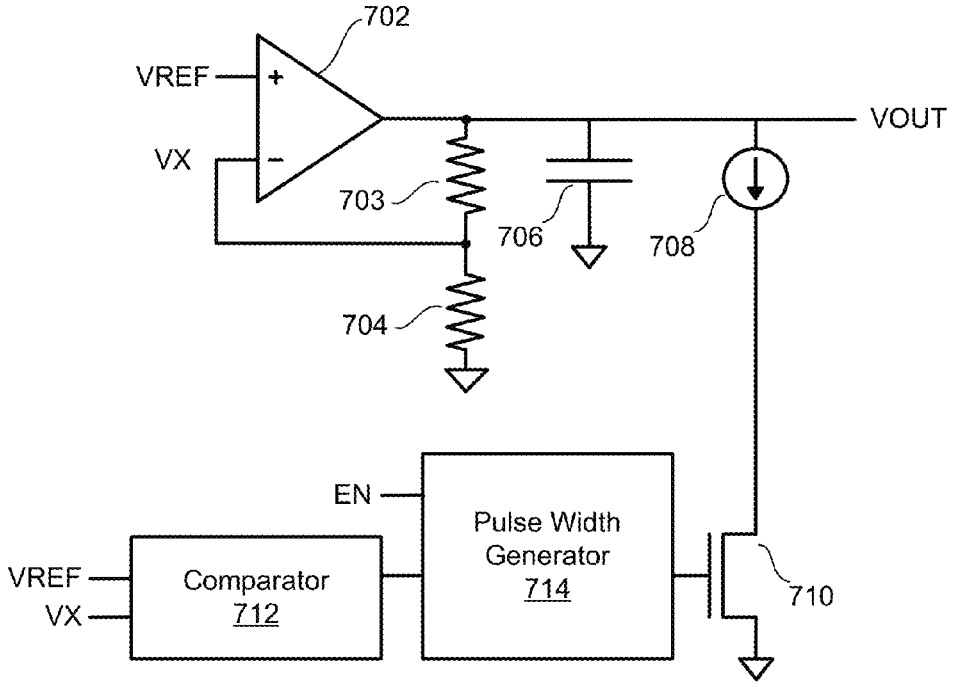
FIG. 7A depicts one embodiment of a voltage regulator comprising a non-inverting amplifier with a configurable voltage divider and current boosting circuitry for reducing the settling time of the voltage regulator.

FIG. 7A depicts one embodiment of a voltage regulator comprising a non-inverting amplifier with a configurable voltage divider and current boosting circuitry for reducing the settling time of the voltage regulator. As depicted, the amplifier 702 is configured in a non-inverting amplifier configuration with a resistive voltage divider formed by resisters 703-704. The amplifier 702 may comprise a differential amplifier. The output of the amplifier 702 is connected to a capacitor 706 and current boosting circuitry comprising NMOS transistor 710, pulse width generator 714, and comparator 712. The reference voltage VREF (e.g., 1.25V) is used as an input to amplifier 702. Due to closed-loop feedback, the voltage at node VX will be close to (or substantially the same as) VREF during regulation and the voltage at node VOUT will be a multiplier higher than the voltage at node VX due to the voltage divider formed by resistors 703 and 704. Upon receiving an enable signal EN (e.g., from one or more control circuits for controlling memory operations), the NMOS transistor 710 may be set into a conducting state such that a boosting current 708 is drawn from the output of the voltage regulator. In one example, the boosting current may comprise 1 mA or 5 mA of additional current drawn from the output of the voltage regulator.

In one embodiment, the comparator 712 may compare the reference voltage VREF with the voltage at node VOUT in order to determine whether the output of the voltage regulator is close to a target regulation point or whether the output of the voltage regulator is close to a desired (or target) regulation voltage for the voltage regulator. In another embodiment, the comparator 712 may be configured to determine that the output of the voltage regulator has reached a particular voltage level, such as that the output of the voltage regulator is within 100 mV of the desired regulation voltage or that the output of the voltage regulator has overshot the desired regulation voltage by 100 mV. The output of the voltage regulator may overshoot the desired regulation voltage when the output of the voltage regulator goes higher than the desired regulation voltage from a preset voltage during a standby mode that is less than the desired regulation voltage. Conversely, the output of the voltage regulator may overshoot the desired regulation voltage when the output of the voltage regulator goes lower than the desired regulation voltage from a preset voltage during a standby mode that is greater than the desired regulation voltage. In one example, if the preset voltage during standby mode is 5V and the desired regulation voltage is 1.25V, then the output of the voltage regulator may overshoot the desired regulation voltage when the output of the voltage regulator goes lower than 1.25V (e.g., hits 1.2V). Once the comparator 712 detects that the output of the voltage regulator has reached a particular voltage level, then the pulse width generator 714 may disable the current boosting and set NMOS transistor 710 into a non-conducting state such that the boosting current 708 is not drawn from the output of the voltage regulator.

Figure 7B:
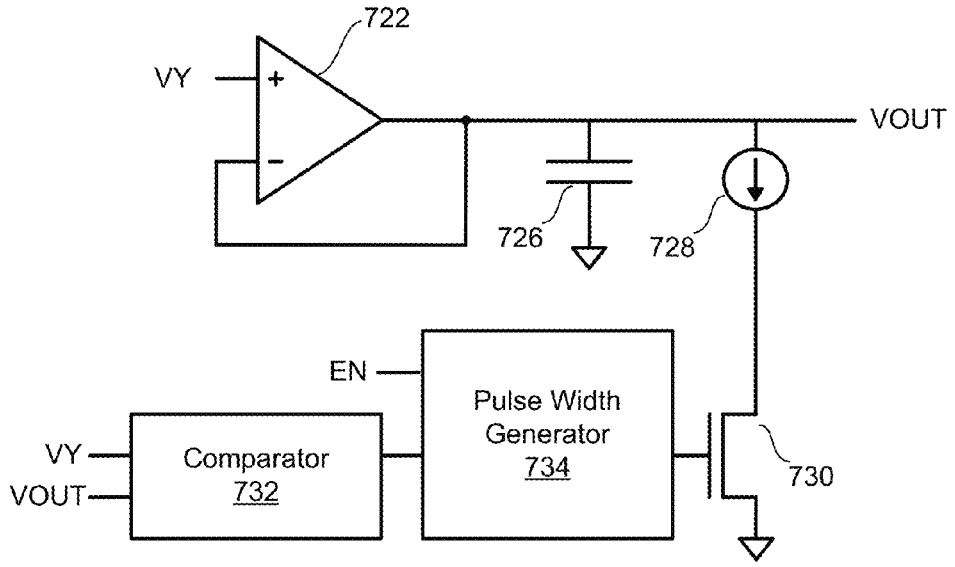
FIG. 7B depicts one embodiment of a voltage regulator comprising a unity gain buffer and current boosting circuitry for reducing the settling time of the voltage regulator.

FIG. 7B depicts one embodiment of a voltage regulator comprising a unity gain buffer and current boosting circuitry for reducing the settling time of the voltage regulator. As depicted, the amplifier 722 is configured in a unity gain amplifier configuration to buffer the voltage VY. The amplifier 722 may comprise a differential amplifier. The output of the amplifier 722 is connected to a capacitor 726 and current boosting circuitry comprising NMOS transistor 730, pulse width generator 734, and comparator 732. Due to closed-loop feedback, the voltage at node VOUT will be at or substantially the same at the voltage VY during regulation. Upon receiving an enable signal EN (e.g., from one or more control circuits for controlling memory operations), the NMOS transistor 730 may be set into a conducting state such that a boosting current 728 (e.g., 1 mA) is drawn from the output of the voltage regulator. In one embodiment, the voltage VY may correspond with a read voltage, a programming voltage, a selected word line voltage, an unselected word line voltage, a selected bit line voltage, or an unselected bit line voltage.

In one embodiment, the comparator 732 may compare the voltage VY with the voltage at node VOUT in order to determine whether the output of the voltage regulator is close to a target regulation point or whether the output of the voltage regulator is close to voltage VY (i.e., in this case, the desired regulation voltage). In another embodiment, the comparator 732 may be configured to determine that the output of the voltage regulator has reached a particular voltage level, such as that the output of the voltage regulator is within 100 mV of the desired regulation voltage or that the output of the voltage regulator has overshot the desired relation voltage by 100 mV. Once the comparator 732 detects that the output of the voltage regulator has reached a particular voltage level, then the pulse width generator 734 may disable the current boosting and set NMOS transistor 730 into a non-conducting state such that the boosting current 728 is not drawn from the output of the voltage regulator.

Figure 7C:
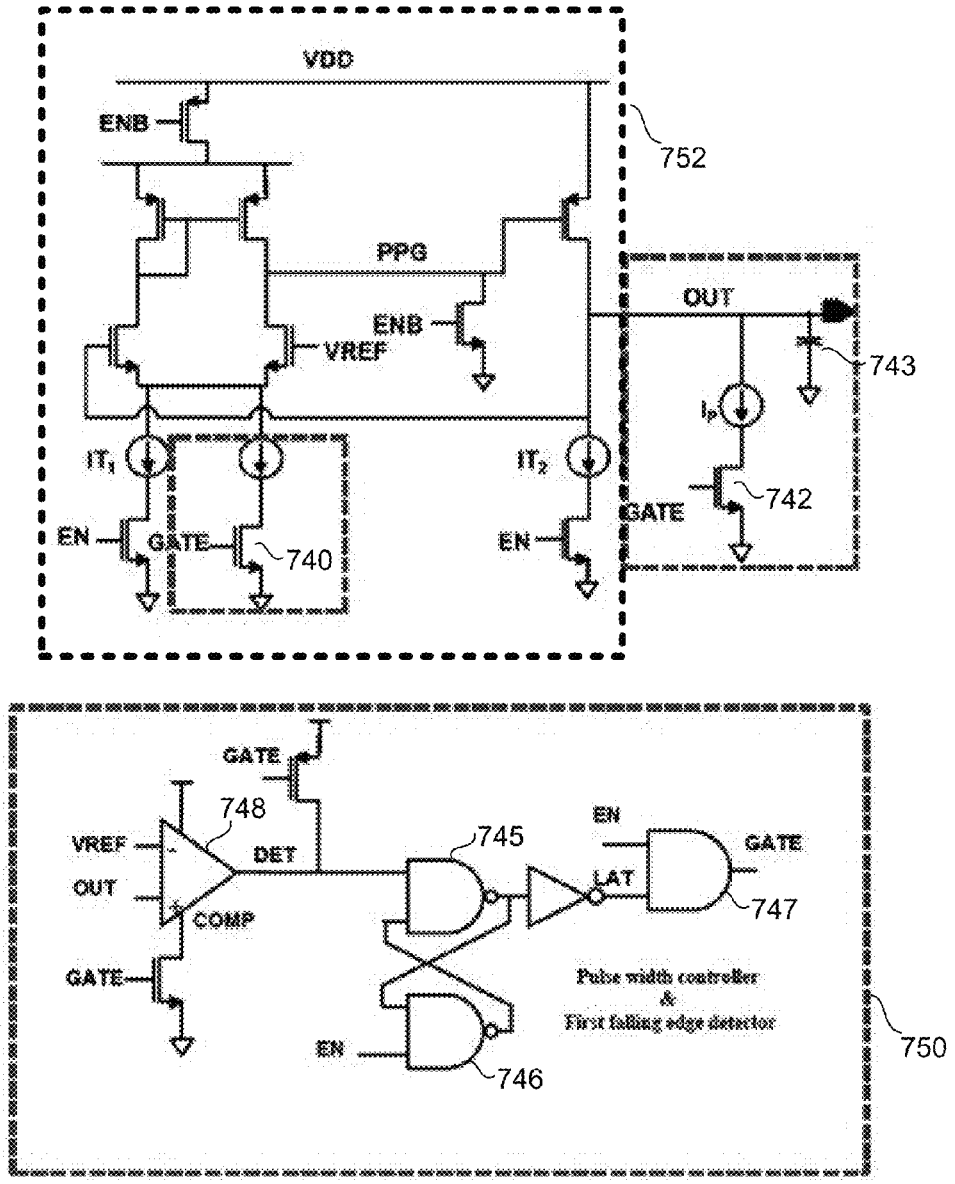
FIG. 7C depicts another embodiment of a voltage regulator comprising a unity gain buffer and current boosting circuitry for reducing the settling time of the voltage regulator.

FIG. 7C depicts another embodiment of a voltage regulator comprising a unity gain buffer and current boosting circuitry for reducing the settling time of the voltage regulator. As depicted, the amplifier 752 is configured in a unity gain amplifier configuration to buffer the voltage VREF. The amplifier 752 may comprise a two stage amplifier with a differential amplifier input stage. The output of the amplifier 752 is connected to a capacitor 743 and current boosting circuitry including NMOS transistor 742 and pulse width controller 750 for controlling the gate of the NMOS transistor 742. The output OUT of the amplifier 752 comprises an input to the comparator 748 of the pulse width controller 750. Due to closed-loop feedback, the voltage at node VOUT will be at or substantially the same at the voltage VREF during regulation. Upon receiving an enable signal EN (e.g., from one or more control circuits for controlling memory operations), the NMOS transistor 742 may be set into a conducting state such that a boosting current IP (e.g., 1 mA) is drawn from the output of the voltage regulator. The pulse width controller 750 includes comparator 748, AND gate 747, and a latch including cross-coupled NAND gates 745-746. The output GATE of the pulse width controller 750 controls the gate of NMOS transistor 742 and the gate of NMOS transistor 740.

Figure 7D:
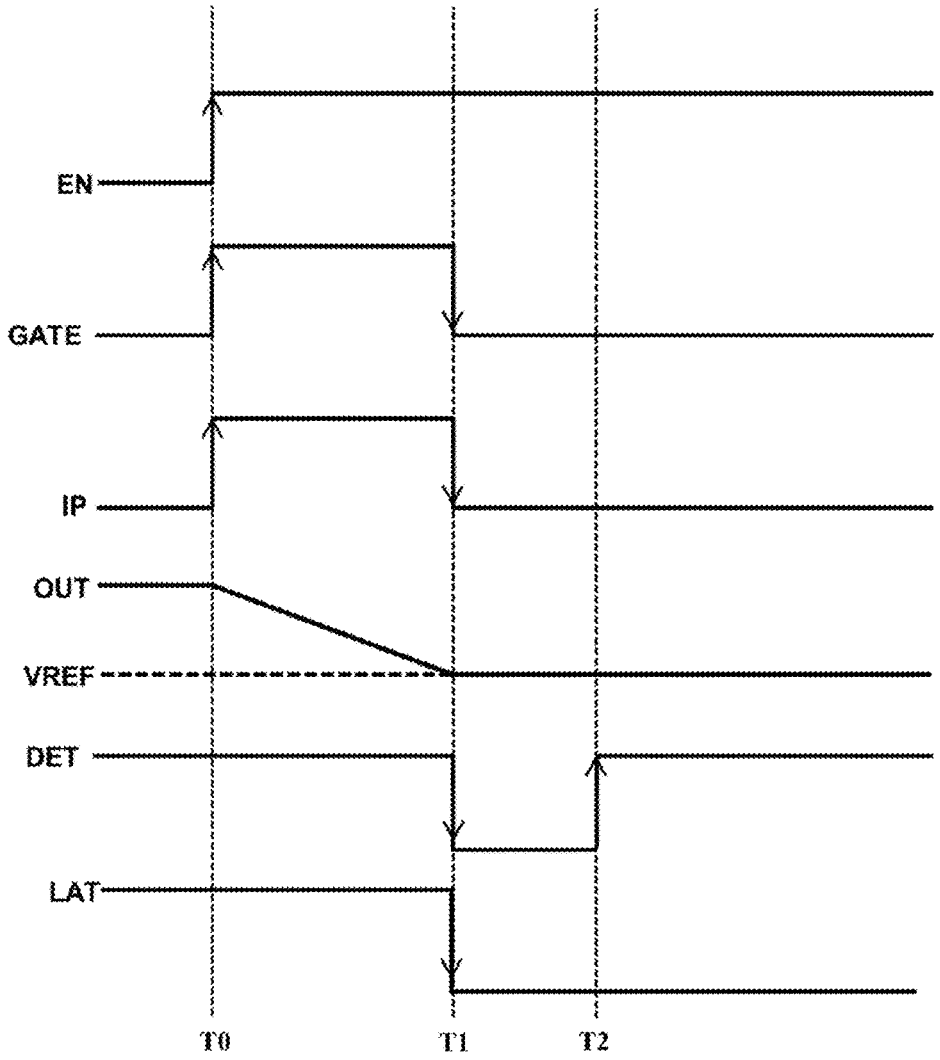
FIG. 7D depicts one embodiment of voltage waveforms for the voltage regulator depicted in FIG. 7A.

FIG. 7D depicts one embodiment of voltage waveforms for the voltage regulator depicted in FIG. 7A. As depicted, at time T0, the enable signal EN received from a controller transitions from a low state to a high state (e.g., from 0V to VDD). The rising edge of the enable signal EN at time T0 causes the signal GATE to transition from the low state to the high state, which in turn causes the boosting current IP to be drawn from the output of the voltage regulator via NMOS transistor 742. Moreover, additional current may be drawn from the differential amplifier input stage via NMOS transistor 740. In response to the boosting current IP being drawn from the output of the voltage regulator, the output of the voltage regulator OUT starts quickly discharging from a preset voltage that is higher than the desired regulation voltage of VREF. At time T1, the output of the voltage regulator OUT reaches the desired regulation voltage of VREF causing the output DET of the comparator 748 to transition from a high state to a low state, which in turn causes the output LAT of the latch comprising the cross-coupled NAND gates 745-746 to transition from a high state to a low state. In this case, the latch latches the disable signal at node LAT. The transition of the disable signal at node LAT from a high state to a low state causes the output of the AND gate 747 to transition from the high state to the low state. At time T2, the output DET of the comparator 748 transitions from the low state to the high state in response to the signal GATE transitioning to the low state. As the disable signal at node LAT has been latched, the disable signal does not change state in response to the output DET of the comparator 748 transitioning to the high state.

Figure 8A:
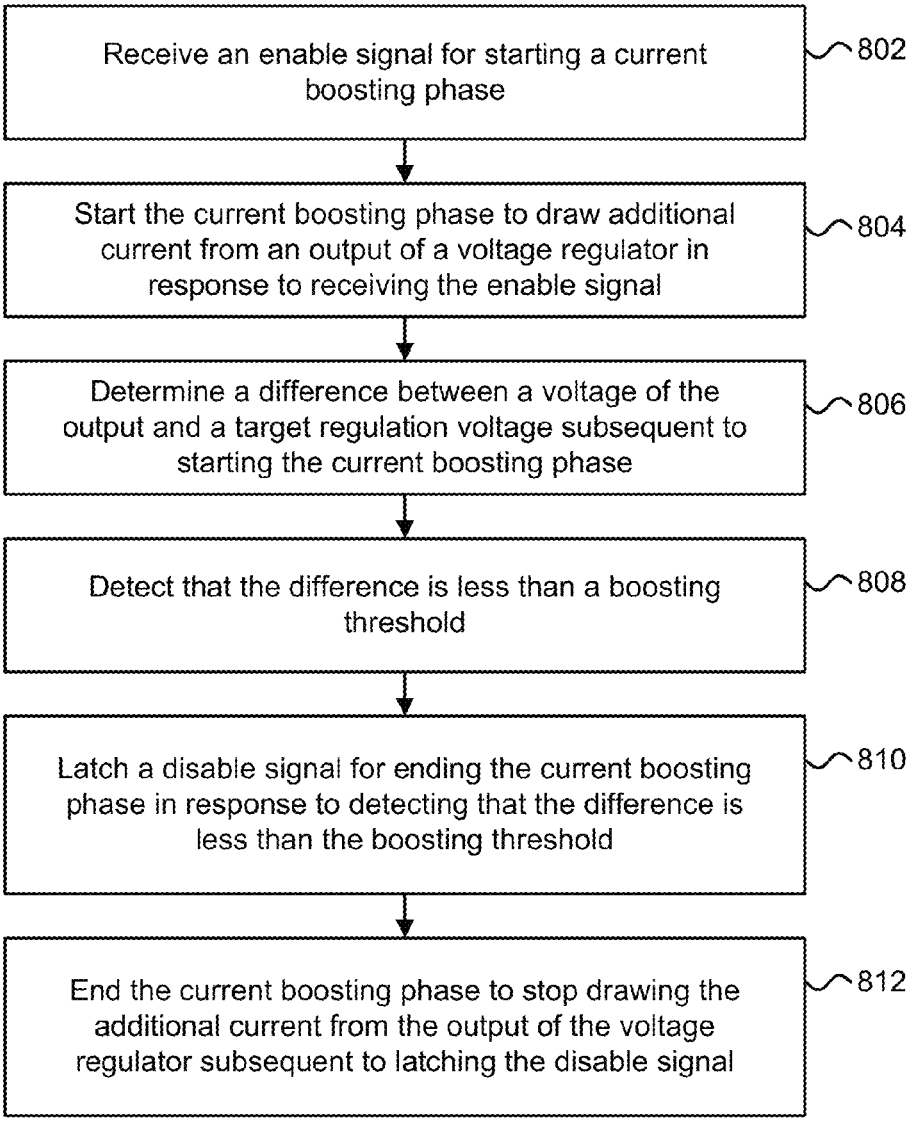
FIG. 8A is a flowchart describing one embodiment of a process for reducing the settling time of a voltage regulator.

FIG. 8A is a flowchart describing one embodiment of a process for reducing the settling time of a voltage regulator. In one embodiment, the process of FIG. 8A may be performed by a voltage regulator, such as the voltage regulators depicted in FIGS. 7A-7C.

In step 802, an enable signal for starting a current boosting phase is received. The enable signal may be received from one or more control circuits for controlling memory operations performed by a memory array, such as control circuitry 510 in FIG. 5A. In step 804, the current boosting phase is started to draw additional current from an output of a voltage regulator in response to receiving the enable signal. In one example, the current boosting phase may cause a transistor (e.g., an NMOS transistor) that is placed in series with a current limiting device or a current source to be set into a conducting state. In some cases, the transistor itself may be sized to limit the amount of additional current drawn from the output of the voltage regulator.

In step 806, a difference between a voltage of the output and a target regulation voltage is determined subsequent to starting the current boosting phase. In step 808, it is detected that the difference is less than a boosting threshold (e.g., that the difference is less than 30 mV). In one example, it is detected that the difference between the voltage of the output of the voltage regulator and the target regulation voltage is less than 150 mV. In step 810, a disable signal for ending the current boosting phase is latched in response to detecting that the difference is less than the boosting threshold. In step 812, the current boosting phase is ended to stop drawing the additional current from the output of the voltage regulator subsequent to latching the disable signal.

Figure 8B:
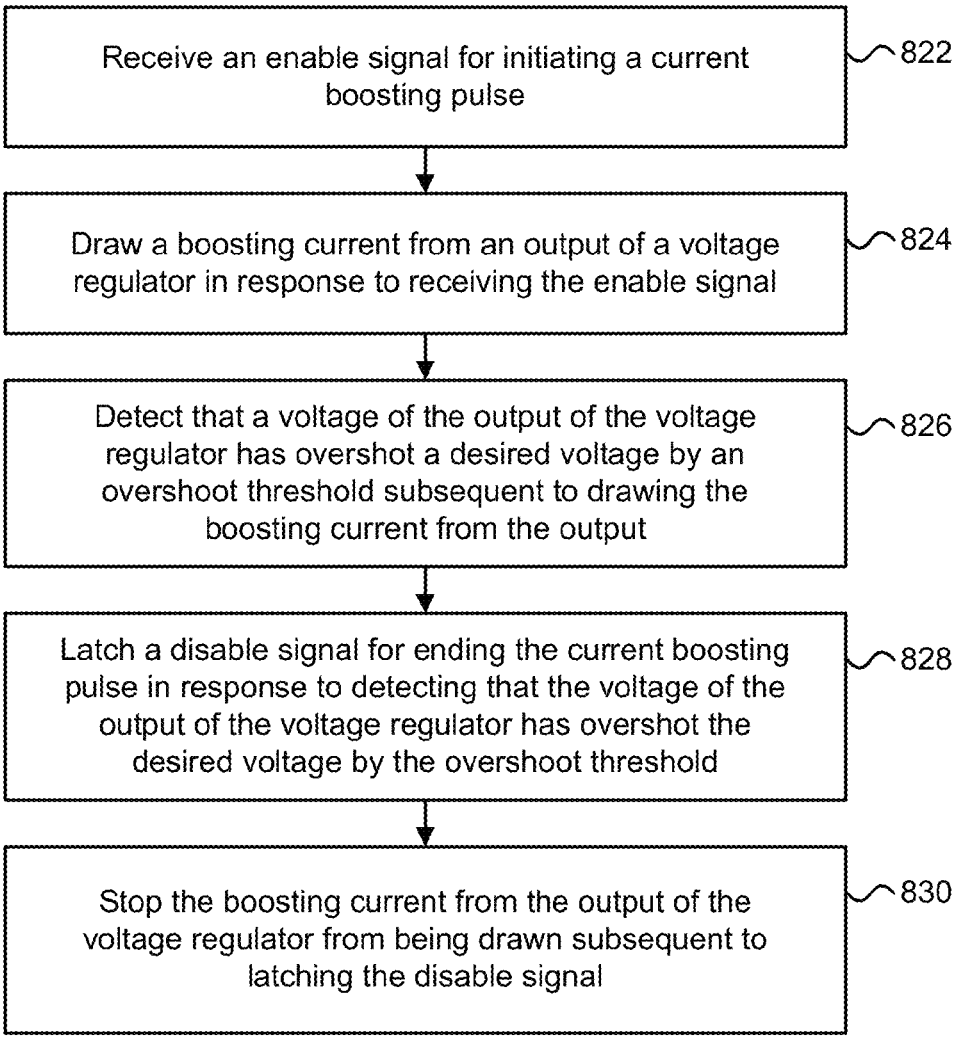
FIG. 8B is a flowchart describing an alternative embodiment of a process for reducing the settling time of a voltage regulator.

FIG. 8B is a flowchart describing an alternative embodiment of a process for reducing the settling time of a voltage regulator. In one embodiment, the process of FIG. 8B may be performed by a voltage regulator, such as the voltage regulators depicted in FIGS. 7A-7C.

In step 822, an enable signal for initiating a current boosting pulse is received. The enable signal may be received from one or more control circuits for controlling memory operations performed by a memory array. In step 824, a boosting current is drawn from an output a voltage regulator in response to receiving the enable signal. In one example, the boosting current may be drawn via an NMOS transistor that is placed in series with the output of the voltage regulator. In some cases, the NMOS transistor may be sized to limit the amount of boosting current drawn from the output of the voltage regulator.

In step 826, it is detected that a voltage of the output of the voltage regulator has overshot a desired voltage (e.g., the target regulation voltage) by an overshoot threshold subsequent to drawing the boosting current from the output. In one example, it may be detected that the output of the voltage regulator has overshot the target regulation voltage by more than 200 mV. The output of the voltage regulator may overshoot the target regulation voltage when the output of the voltage regulator goes higher than the target regulation voltage from a precharged or preset voltage used during a standby mode that is less than the target regulation voltage. The output of the voltage regulator may overshoot the target regulation voltage when the output of the voltage regulator goes lower than the target regulation voltage from a precharged or preset voltage used during a standby mode that is greater than the target regulation voltage. In one example, if the preset voltage during standby mode of the voltage regulator is 0V and the target regulation voltage is 1.25V, then the output of the voltage regulator may overshoot the target regulation voltage when the output of the voltage regulator goes higher than 1.25V (e.g., hits 1.3V).

In step 828, a disable signal for ending the current boosting pulse is latched in response to detecting that the voltage of the output of the voltage regulator has overshot the desired voltage by the overshoot threshold. In step 830, the boosting current is prevented or stopped from being drawn from the output of the voltage regulator subsequent to latching the disable signal.

One embodiment of the disclosed technology includes a voltage regulator and a current boosting circuit. The current boosting circuit configured to draw a boosting current from an output of the voltage regulator in response to receipt of an enable signal and configured to detect that the output exceeds a target regulation voltage by at least a first voltage subsequent to the boosting current being drawn from the output. The current boosting circuit configured to prevent the boosting current from being drawn from the output until the enable signal toggles in response to detecting that the output exceeds the target regulation voltage by at least the first voltage.

One embodiment of the disclosed technology includes a voltage regulator and a current boosting circuit. The current boosting circuit configured to draw a boosting current from an output of the voltage regulator in response to receipt of an enable signal and configured to detect that the output has overshot a target regulation voltage by at least a first voltage subsequent to the boosting current being drawn from the output. The current boosting circuit configured to latch a disable signal in response to detection of the output overshooting the target regulation voltage by at least the first voltage and configured to prevent the boosting current from being drawn from the output in response to the disable signal being latched.

One embodiment of the disclosed technology includes drawing additional current from an output of a voltage regulator in response to receiving an enable signal, determining a voltage difference between the output and a target regulation voltage, detecting that the output has overshot the target regulation voltage by at least a first voltage based on the voltage difference, latching a disable signal in response to detecting that the output has overshot the target regulation voltage by at least the first voltage, and preventing the additional current from being drawn from the output of the voltage regulator in response to latching the disable signal.

One embodiment of the disclosed technology includes a unity gain amplifier and a current boosting circuit configured to draw a boosting current from an output of the unity gain amplifier in response to receipt of an enable signal and configured to detect that the output has reached a target regulation voltage subsequent to the boosting current being drawn from the output. The current boosting circuit configured to latch a disable signal in response to detection that the output has reached the target regulation voltage and configured to prevent the boosting current from being drawn from the output in response to the disable signal being latched.

For purposes of this document, it should be noted that the dimensions of the various features depicted in the figures may not necessarily be drawn to scale.

For purposes of this document, reference in the specification to "an embodiment," "one embodiment," "some embodiments," or "another embodiment" may be used to describe different embodiments and do not necessarily refer to the same embodiment.

For purposes of this document, a connection may be a direct connection or an indirect connection (e.g., via another part). In some cases, when an element is referred to as being connected or coupled to another element, the element may be directly connected to the other element or indirectly connected to the other element via intervening elements. When an element is referred to as being directly connected to another element, then there are no intervening elements between the element and the other element.

For purposes of this document, the term "based on" may be read as "based at least in part on."

For purposes of this document, without additional context, use of numerical terms such as a "first" object, a "second" object, and a "third" object may not imply an ordering of objects, but may instead be used for identification purposes to identify different objects.

For purposes of this document, the term "set" of objects may refer to a "set" of one or more of the objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus, comprising:

a voltage regulator; and a current boosting circuit configured to draw a boosting current from an output of the voltage regulator in response to receipt of an enable signal and configured to detect that the output exceeds a target regulation voltage by at least a first voltage subsequent to the boosting current being drawn from the output, the current boosting circuit configured to prevent the boosting current from being drawn from the output until the enable signal toggles in response to detecting that the output exceeds the target regulation voltage by at least the first voltage, a preset voltage of the output prior to the boosting current being drawn from the output is greater than the target regulation voltage and the current boosting circuit configured to detect that the output has overshot the target regulation voltage by the first voltage when the output is less than the target regulation voltage by at least the first voltage.

2. The apparatus of claim 1, wherein:

the current boosting circuit configured to set the first voltage based on a difference between the target regulation voltage and the preset voltage of the output prior to the boosting current being drawn from the output.

3. The apparatus of claim 1, wherein:

the current boosting circuit configured to set the first voltage based on the target regulation voltage.

4. The apparatus of claim 1, wherein:

the current boosting circuit configured to determine a voltage difference between the output and the target regulation voltage and to detect that the output has overshot the target regulation voltage by the first voltage based on the voltage difference.

5. The apparatus of claim 1, wherein:

the target regulation voltage corresponds with an unselected word line voltage.

6. The apparatus of claim 1, wherein:

the current boosting circuit configured to latch a disable signal in response to detection of the output exceeding the target regulation voltage by at least the first voltage and configured to prevent the boosting current from being drawn from the output in response to the disable signal being latched.

7. The apparatus of claim 1, wherein:

the current boosting circuit configured to set a transistor connected to the output into a conducting state in response to the enable signal being received.

8. The apparatus of claim 1, wherein:

the current boosting circuit configured to set a transistor connected to the output into a non-conducting state in response to the disable signal being latched.

9. The apparatus of claim 1, wherein:

the current boosting circuit configured to receive the enable signal from one or more control circuits.

10. The apparatus of claim 1, wherein:

the voltage regulator is arranged on a NAND memory die.

11. The apparatus of claim 1, wherein:

the voltage regulator is arranged on a memory die that includes non-volatile memory that is monolithically formed in one or more physical levels of memory cells having active areas disposed above a silicon substrate.

12. A system, comprising:

a unity gain amplifier; and a current boosting circuit configured to draw a boosting current from an output of the unity gain amplifier in response to receipt of an enable signal and configured to detect that the output exceeded a target regulation voltage by at least a first voltage subsequent to the boosting current being drawn from the output, the current boosting circuit configured to record a disable signal in response to detection that the output has exceeded the target regulation voltage by at least the first voltage and configured to prevent the boosting current from being drawn from the output until the enable signal toggles in response to the disable signal being recorded, a preset voltage of the output prior to the boosting current being drawn from the output is greater than the target regulation voltage and the current boosting circuit configured to detect that the output has overshot the target regulation voltage by the first voltage when the output is less than the target regulation voltage by at least the first voltage.

13. The system of claim 12, wherein:

the unity gain amplifier is arranged on a NAND memory die.

14. An apparatus, comprising:

a voltage regulator; and a current boosting circuit configured to draw a boosting current from an output of the voltage regulator in response to receipt of an enable signal and configured to detect that the output exceeds a target regulation voltage by at least a first voltage subsequent to the boosting current being drawn from the output, the current boosting circuit configured to prevent the boosting current from being drawn from the output until the enable signal toggles in response to detecting that the output exceeds the target regulation voltage by at least the first voltage, a preset voltage of the output prior to the boosting current being drawn from the output is less than the target regulation voltage and the current boosting circuit configured to detect that the output has overshot the target regulation voltage by the first voltage when the output is greater than the target regulation voltage by at least the first voltage.

15. The apparatus of claim 14, wherein:

the current boosting circuit configured to set the first voltage based on a difference between the target regulation voltage and the preset voltage of the output prior to the boosting current being drawn from the output.

16. The apparatus of claim 14, wherein:

the current boosting circuit configured to set the first voltage based on the target regulation voltage.

17. The apparatus of claim 14, wherein:

the current boosting circuit configured to determine a voltage difference between the output and the target regulation voltage and to detect that the output has overshot the target regulation voltage by the first voltage based on the voltage difference.

18. The apparatus of claim 14, wherein:

the target regulation voltage corresponds with an unselected word line voltage.

19. The apparatus of claim 14, wherein:

the current boosting circuit configured to latch a disable signal in response to detection of the output exceeding the target regulation voltage by at least the first voltage and configured to prevent the boosting current from being drawn from the output in response to the disable signal being latched.

20. The apparatus of claim 14, wherein:

the current boosting circuit configured to set a transistor connected to the output into a conducting state in response to the enable signal being received.

* * * * *